US007832347B2

(12) United States Patent
Pascucci

(10) Patent No.: US 7,832,347 B2
(45) Date of Patent: Nov. 16, 2010

(54) FLOATATION APPARATUS AND METHODS FOR PROVIDING A FLOATATION APPARATUS

(76) Inventor: Ralph A. Pascucci, 929 Route 29, Saratoga Springs, NY (US) 12866

( * ) Notice: Subject to any disclaimer, the term of this patent is extended or adjusted under 35 U.S.C. 154(b) by 204 days.

(21) Appl. No.: 12/132,947

(22) Filed: Jun. 4, 2008

(65) Prior Publication Data

US 2008/0295757 A1 Dec. 4, 2008

Related U.S. Application Data

(60) Provisional application No. 60/941,723, filed on Jun. 4, 2007.

(51) Int. Cl.
*B63B 43/14* (2006.01)
*B63B 39/00* (2006.01)
*B63B 43/02* (2006.01)

(52) U.S. Cl. ..... 114/123; 114/122

(58) Field of Classification Search ..... 114/121–123, 114/264–267, 271, 283, 292, 343, 347, 360, 114/364; 440/101, 104–106; 441/65, 79, 441/133, 134, 136
See application file for complete search history.

(56) References Cited

U.S. PATENT DOCUMENTS 3,611,461 A * 10/1971 Wurzberger ..... 114/357
4,776,821 A * 10/1988 duPont ..... 440/101
2003/0194923 A1* 10/2003 Benoit ..... 440/12.5

* cited by examiner

*Primary Examiner*—Daniel V Venne
(74) *Attorney, Agent, or Firm*—Heslin Rothenberg Farley & Mesiti P.C.

(57) ABSTRACT

A floatation apparatus attachable to an outrigger extending from a side of a boat such as a shell for rowing includes a buoyant member, and at least one releasably attachable member operably attachable to the buoyant member for releasably attaching the floatation apparatus to the outrigger so that the buoyant member is spaced-apart from the surface of the water when the boat is orientated upright. In one embodiment, the buoyant member is a generally triangular-shaped planar member receivable between a triangular-shaped opening defined by a plurality of elongated members of the outrigger and the side of the boat. Also disclosed are methods for aiding a rower of a boat in the event that the boat capsizes, and methods for inhibiting capsizing of a rowing boat having at least one outrigger extending from each side of the rowing boat for supporting a plurality of oarlocks.

18 Claims, 10 Drawing Sheets

FLOATATION APPARATUS AND METHODS FOR PROVIDING A FLOATATION APPARATUS

CLAIM TO PRIORITY

This application claims the benefit of U.S. Provisional Application No. 60/941,723, filed Jun. 4, 2007, entitled "Floatation Apparatus," the entire subject matter of which is hereby incorporated herein by reference.

FIELD OF THE INVENTION

This invention relates generally to floatation devices, and more particularly to floatation apparatus for boats having outriggers for supporting an oarlock.

BACKGROUND OF THE INVENTION

The sport of rowing requires a rower or multiple rowers to operate oars of a rowing shell from a cockpit. The oars are attached to outriggers such as a triangular metal frame that holds the oarlock, into which the oar is slotted, away from the side of the shell to optimize leverage. In an effort to provide a shield and inhibit water from splashing into the shell, some rowers have placed duct tape spanning across the triangular metal frame of the outriggers.

In addition, the cockpit of a rowing shell is very limited and confined. The shells are designed in such a fashion to accommodate the rowers with little or no room for storage. As a result, the rowers normally do not carry any personal safety flotation devices as they row. If any personal flotation devices is available at all, it is usually carried aboard a chase boat. However, the chase boat is often supporting several rowing shells, which may be spread over some distance.

There is a need for floatation devices, and more particularly to floatation apparatus for boats having outriggers for supporting an oarlock.

SUMMARY OF THE INVENTION

In a first aspect, the present invention provides a floatation apparatus attachable to an outrigger extending from a side of a rowing boat for supporting an oarlock. The floatation apparatus includes a buoyant member, and at least one releasably attachable means operably attachable to the buoyant member for releasably attaching the floatation apparatus to the outrigger, and wherein the buoyant member is sized and shaped and the releasably attachable means are operable to support the buoyant member spaced-apart from the surface of the water when the boat is orientated upright.

In a second aspect, the present invention provides a floatation apparatus attachable to an outrigger extending from a side of a rowing boat for supporting an oarlock. The floatation apparatus includes a generally triangular-shaped planar member receivable between a triangular-shaped opening defined by a plurality of elongated members of the outrigger and the side of the boat, a plurality of releasably attachable members attachable to the generally triangular-shaped planar member for releasably attaching the floatation apparatus to the outrigger so that the generally triangular-shaped planar member is spaced-apart from the surface of the water when the boat is oriented upright, and wherein said generally triangular-shaped planar member comprises a buoyant material.

In a third aspect, the present invention provides a method for aiding a rower of a boat in the event that the boat capsizes. The method includes providing a buoyant member, releasably attaching the buoyant member to at least one elongated member of an outrigger extending from a side of the boat for supporting an oarlock, rowing the boat with the buoyant member attached to the outrigger and with the buoyant member spaced-apart from the surface of the water, capsizing the boat, removing the buoyant member from the outrigger, and using the buoyant member as a personal floatation device.

In a fourth aspect, the present invention provides a method for inhibiting capsizing of a rowing boat having at least one outrigger extending from each side of the rowing boat for supporting a plurality of oarlocks. The method includes providing a plurality of buoyant members, attaching the plurality of buoyant members to the at least one outrigger extending from each of the opposite sides of the rowing boat, rowing the boat with the plurality of buoyant member attached to the outriggers and spaced-apart from the surface of the water, rotating the boat in the water to one side to contact at least one of the buoyant members in the water to thereby inhibit further rotation of the rowing boat.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

The present invention is directed to floatation apparatus used in association with single or multiple occupant rowing shells without encumbering its occupants. For example, one or more floatation apparatus of the present invention are releasably attachable to outriggers of the rowing shell to provide stability to the rowing shell during turbulent conditions on the water (e.g., inhibits the shell from overturning), hinder rough water from washing into the cockpit of the shell, and provide a personal floatation device for the rowers should the shell capsize or sink. While the present description is directed to rowing shells, from the present description it will be appreciated that other types of boats having an outrigger for supporting an oarlock may employ the floatation apparatus of the present invention.

There are basically two types of rowing shells that reflect two types of rowing, e.g., sweeping rowing and sculling. In sweep rowing, each rower handles a single oar and in sculling each rower uses two oars, or sculls. A shell typically includes a hull that is only about ⅛ inch to about ¼ inch thick to make it as light as possible. Each rower has his/her back to the direction the shell is moving and power is generated using a blended sequence of the rower's legs, back and arms. The rower sits on a sliding seat with wheels on a track called a slide.

Figure 1:
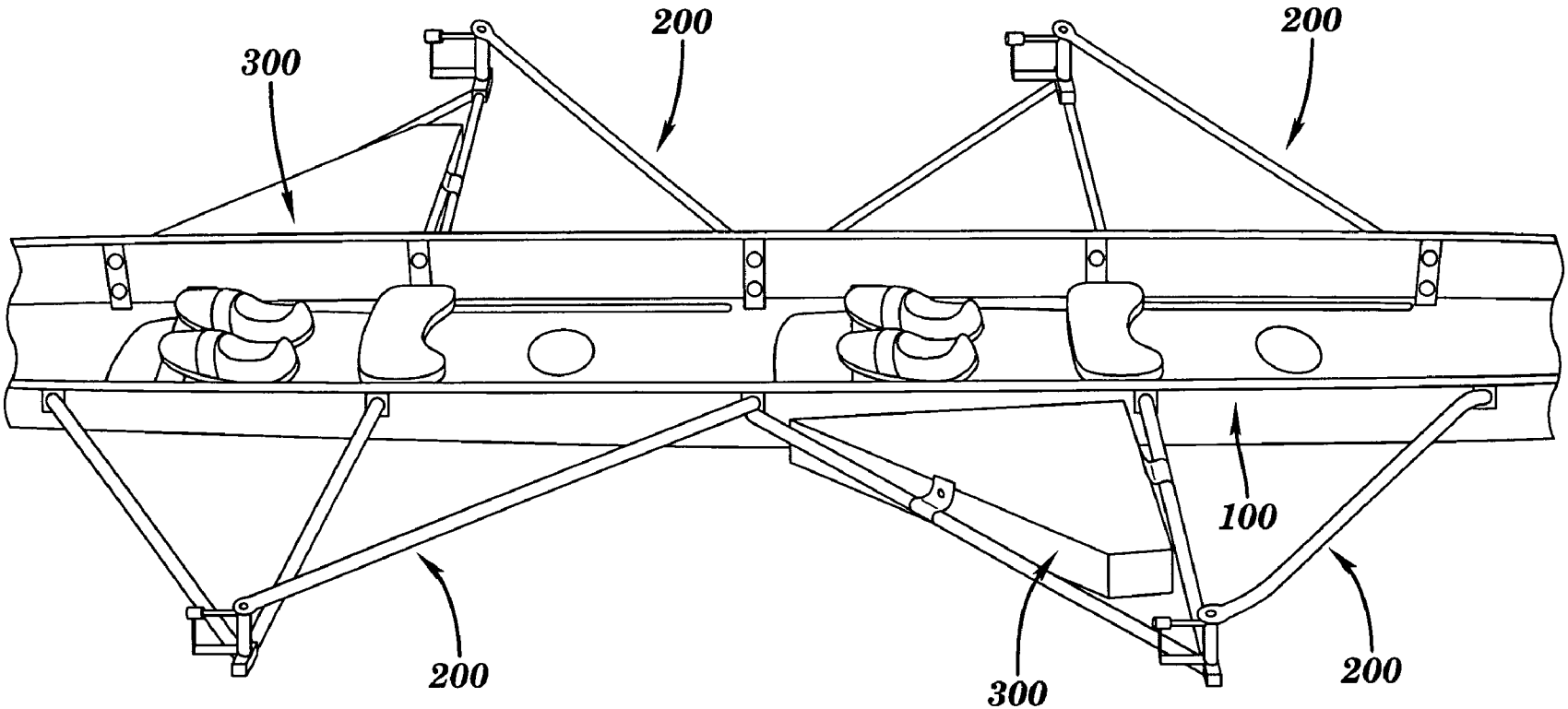
FIG. 1 is a perspective view of a rowing shell with outriggers and one embodiment of a floatation apparatus in accordance with the present invention.
Figure 2:
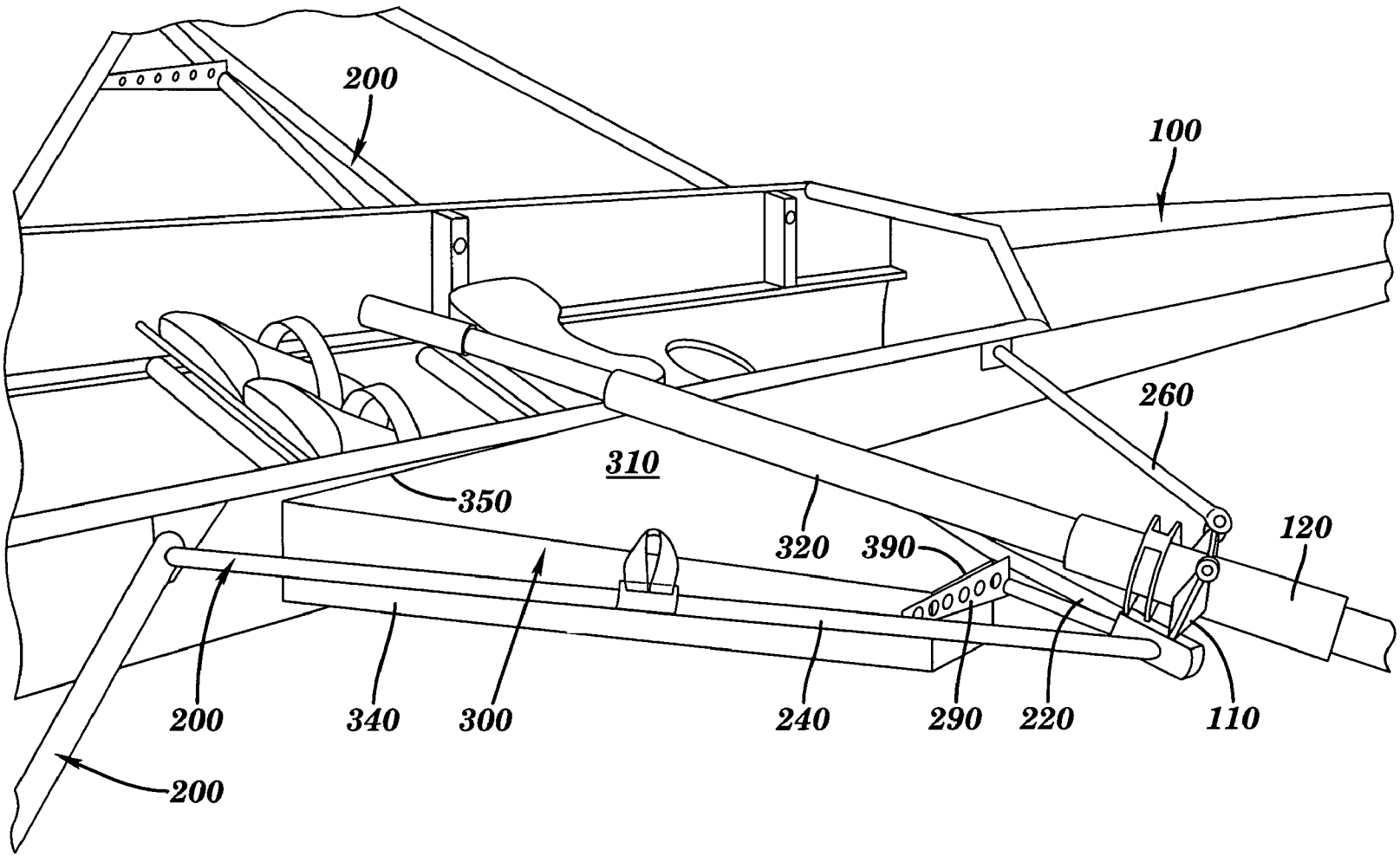
FIG. 2 is an enlarged perspective view of the floatation apparatus of FIG. 1.

FIGS. 1 and 2 illustrate a shell 100 rigged for sculling which includes a plurality of outriggers 200 to which outriggers are attached floatation apparatus 300 in accordance with the present invention. The outrigger is typically a triangular metal frame that holds a U-shaped swivel or oarlock 110 (FIG. 2) into which an oar 120 (FIG. 2) is slotted away from the shell to optimize leverage.

As best shown in FIG. 2, outrigger 200 may be an assembly of a plurality of elongated members 220, 240, and 260 that are attached to the body of shell 100. For example, elongated member 220 may be attached at one end to the shell and disposed laterally or normal to the side of the shell. Elongated member 220 may comprise a pair of elongated members, one disposed on top of the other which taper toward each other and meet at the outer ends. Elongated members 240 and 260 may be attached at one end to the shell and disposed at an angle relative to the longitudinal axis of the shell. The outer ends of elongated members 240 and 260 may be operably connected to the outer end of elongated member 220 to support the oarlock. A cross brace 290 may be disposed adjacent to the outer intersection of elongated member 220 and 240. In this embodiment, each outrigger 200 may define a first generally right triangle opening and a second generally right triangle opening disposed between the elongated members and the shell.

The floatation apparatus 300, in one embodiment, may include a generally triangular-shaped planar member 310 which is sized to be received within the generally triangular-shaped opening defined by the elongated members, the cross brace, and the shell. For example, two peripheral edges 320 and 340 of the floatation apparatus may be disposed adjacent to elongated members 220 and 240, respectively, and a third peripheral edge 350 may be disposed adjacent to the side of shell 100. A fourth peripheral edge 390 may be disposed adjacent to cross brace 290.

Figure 3:
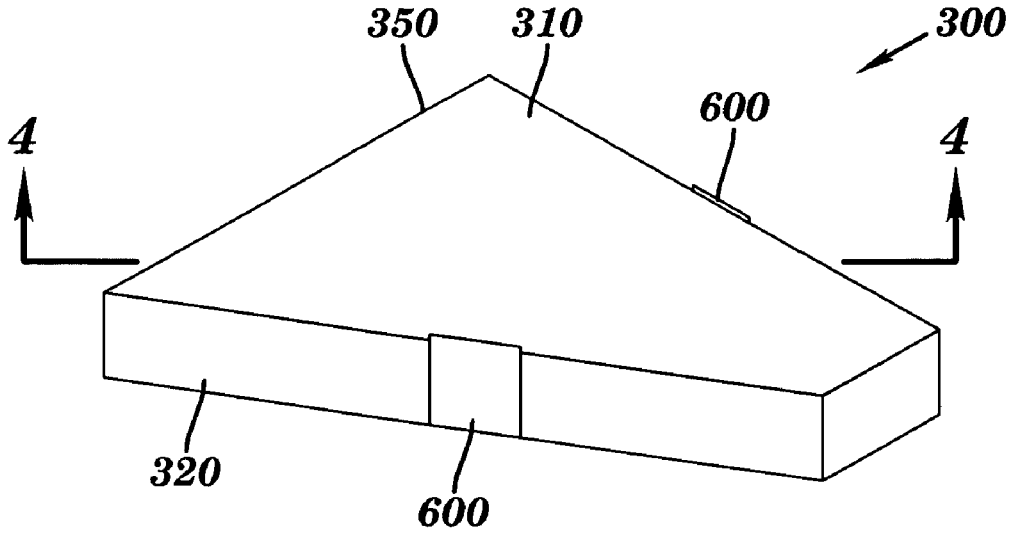
FIG. 3 a perspective view of the floatation apparatus of FIGS. 1 and 2.
Figure 4:
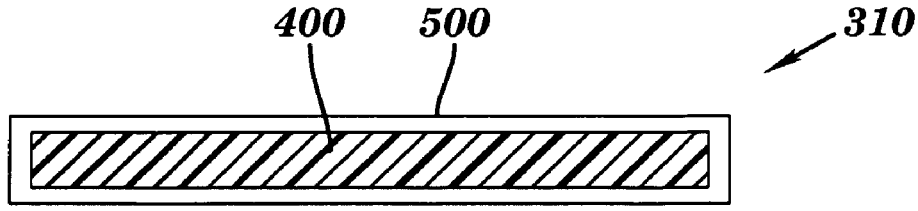
FIG. 4 is a cross-sectional view taken along line 4-4 in FIG. 3.

As best shown in FIGS. 3 and 4, floatation apparatus 300 may include a generally triangular-shaped planar buoyant member 310 and plurality of releasably attachable members 600 for attaching the floatation apparatus to the outrigger. Generally triangular-shaped planar buoyant member 310 may include a triangular-shaped buoyant material 400 (FIG. 4) and a cover 500 (FIG. 4) that extends around buoyant material 400. Buoyant material 400 may be molded or cut from closed cell foam or other suitable buoyant material and cover 500 may be a formed from a water resistant fabric of other suitable material. Releasably attachable members 600 may be formed from, for example, a web, line, rope, loop and hook fasteners, fabric, snap fasteners, or any other means that permit the floatation device to be securely connected to the outrigger to withstand turbulent conditions on the water, while permitting a rower to quickly detach or disconnect the floatation apparatus in time of need.

Figure 5:
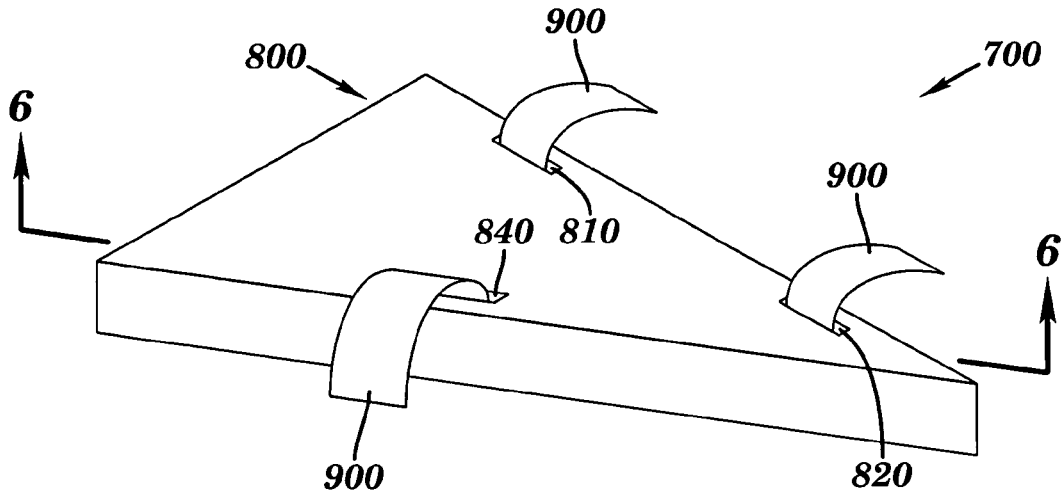
FIG. 5 is a perspective view of another embodiment of a floatation apparatus in accordance with the present invention.
Figure 6:
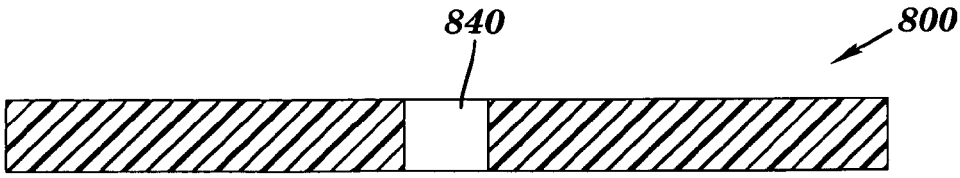
FIG. 6 is a cross-sectional view taken along line 6-6 in FIG. 5.

FIG. 5 illustrates another embodiment of a floatation apparatus 700 in accordance with the present invention. In this embodiment, floatation apparatus 700 may include a generally triangular-shaped planar buoyant member 800 having a plurality of apertures 810, 820, and 840 which extending from a top surface to a bottom surface for receiving, for example, releasably attachable straps 900 (FIG. 5) for attaching the floatation apparatus to the elongated members of the outrigger. For example, buoyant member 800 may be molded or cut from closed cell foam or other suitable buoyant material. The releasably attachable members may be a web, line, rope, loop and hook fasteners, fabric, snap fasteners, or any other means that permit the floatation device to be securely connected to the outrigger to withstand turbulent conditions on the water, while permitting a rower to quickly detach or disconnect the floatation device in time of need. From the present description, it will be appreciated that the apertures may be disposed at other suitable positions for allowing the attachment of the buoyant material to the outriggers. In this illustrated embodiment, the triangular-shaped member may be disposed between elongated member not having a cross brace. Where a cross brace is employed the end of one of the corners of the triangle may be removed, e.g., as shown in FIG. 3. In the exemplary embodiment shown in FIGS. 5 and 6 (and FIGS. 1-4), the buoyant material may be a 3-inch polyethylene foam having a 2-pound density. The apparatus may include three slots (e.g., 2 inches long and 1 inch wide) for nylon webbing and which may include reinforcing grommets. It will be appreciated that two or more than three apertures may be employed. In the above examples, the floatation apparatus may have sides of about 1.5 feet to about 2 feet, or greater.

Figure 7:
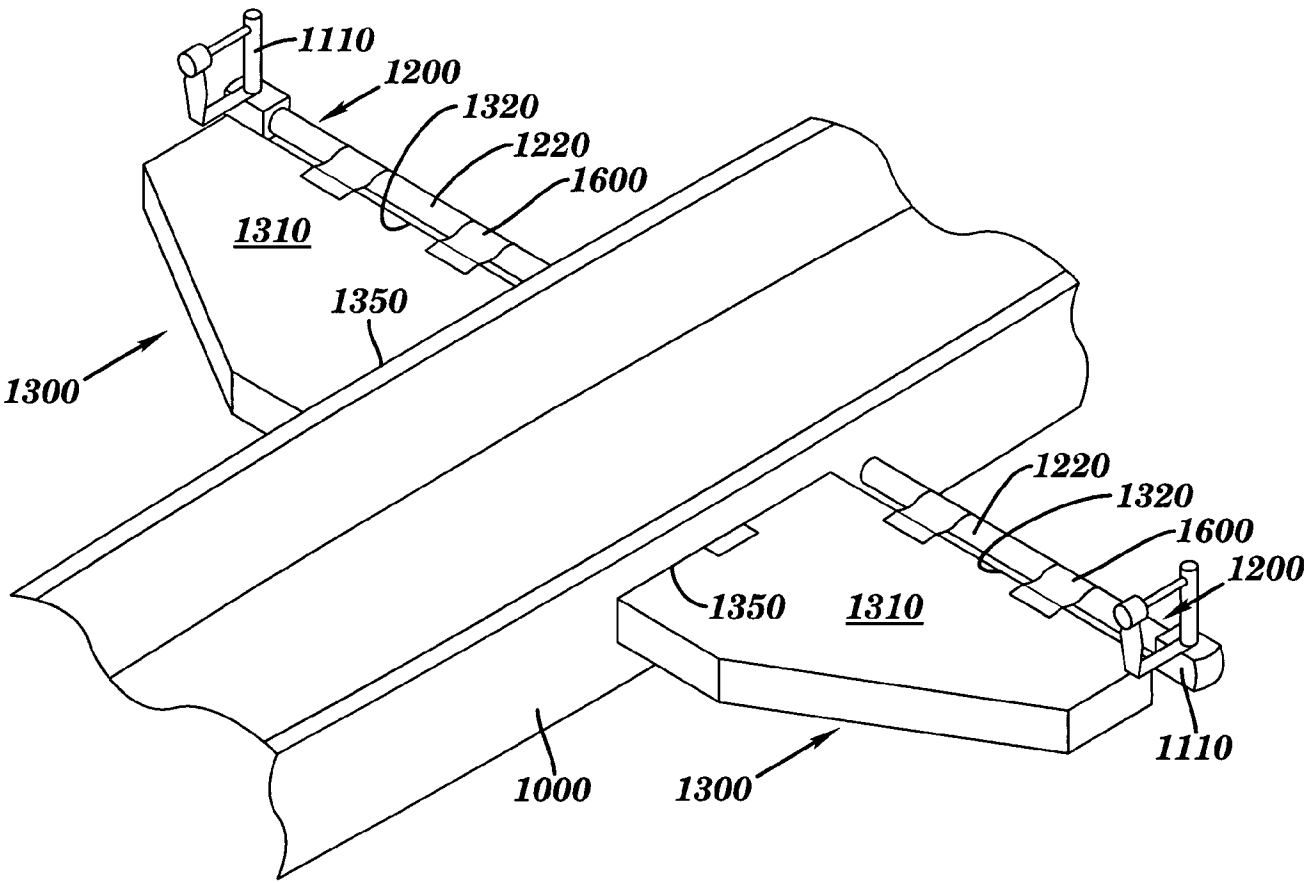
FIG. 7 is a perspective view of a rowing shell outriggers and another embodiment of a floatation apparatus in accordance with the present invention.

FIG. 7 is another embodiment of a shell 1000 rigged for sculling which includes a plurality of outriggers 1200 to which outriggers are attached a plurality of floatation apparatus 1300 in accordance with the present invention. In this embodiment, the outrigger is an elongated member 1220 that extends normally from the side of the shell to hold a U-shaped swivel or oarlock 1110 into which an oar is slotted.

Floatation apparatus 1300 may include a generally planar triangular-shaped member 1310 having two of the corners removed. For example, one peripheral edge 1320 of the floatation apparatus may be disposed adjacent to elongated member 1220, and a peripheral edge 1350 may be disposed adjacent to the side of shell 1000. Floatation apparatus 1300 may include a plurality of releasably attachable members 1600 for attaching the floatation apparatus to the outrigger and to the shell. Releasably attachable members 1600 may be formed from, for example, a web, line, rope, loop and hook fasteners, fabric, snap fasteners, or any other means that permit the floatation device to be securely connected to the outrigger to withstand turbulent conditions on the water, while permitting a rower to quickly detach or disconnect the floatation apparatus in time of need. For example, straps may be attached to the floatation apparatus or pass through an aperture in the flotation apparatus and releasably attach to the outrigger and to the shell. The shell may include a fitting attached to the side of the shell to which the strap may be attached.

Figure 8:
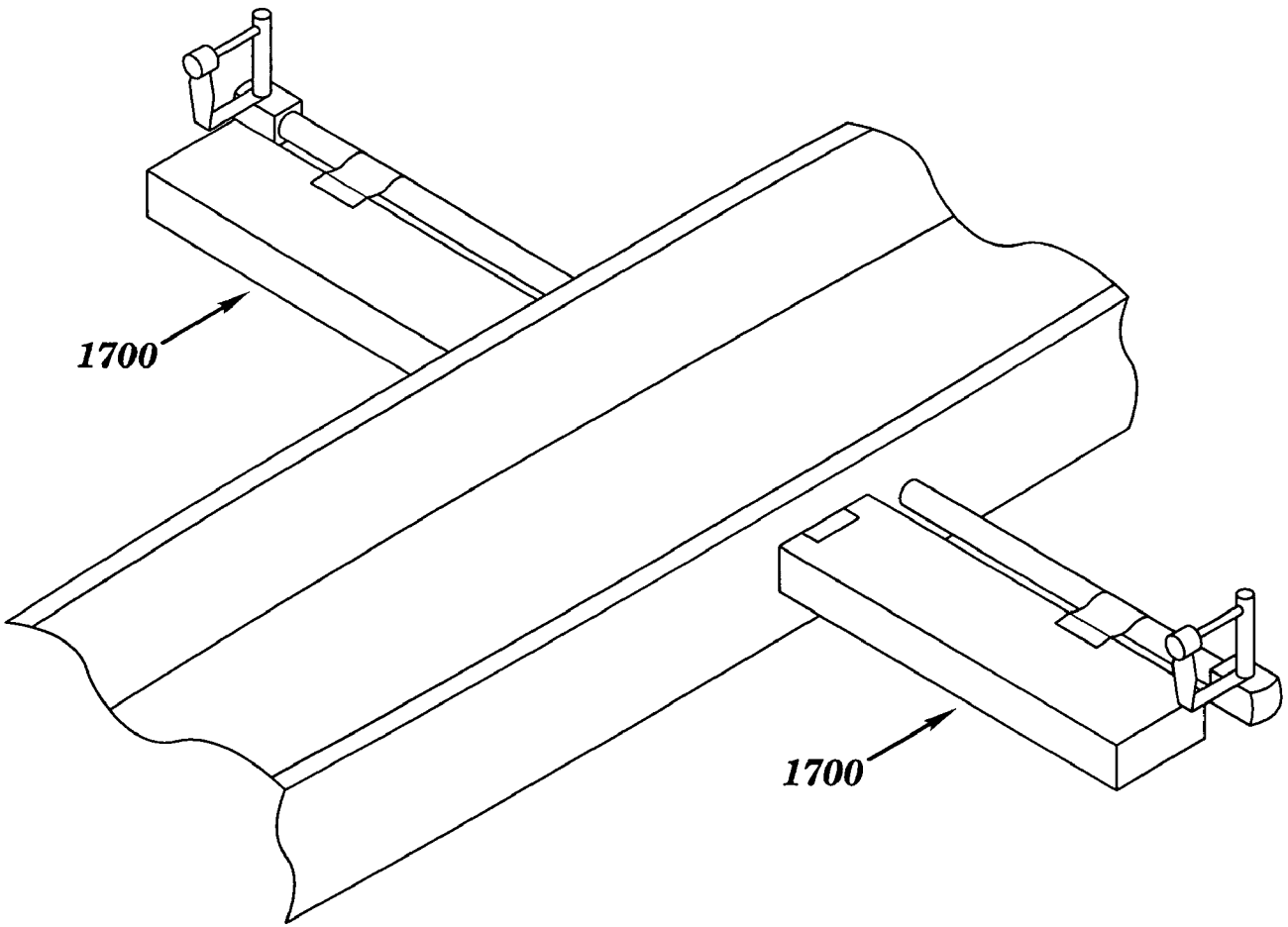
FIG. 8 is a perspective view of a shell with an outrigger and another embodiment of a floatation apparatus in accordance with the present invention.
Figure 10:
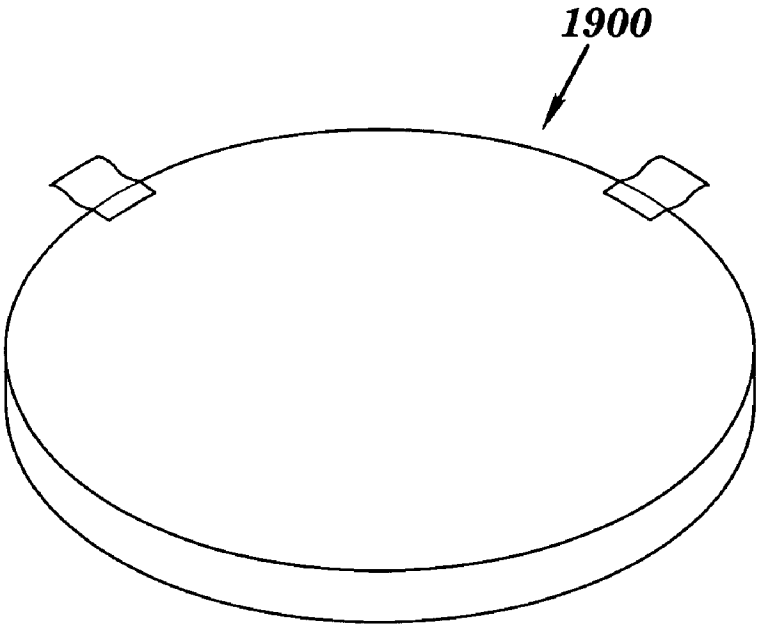
FIG. 10 is a perspective view of another embodiment of a floatation apparatus in accordance with the present invention.
Figure 9:
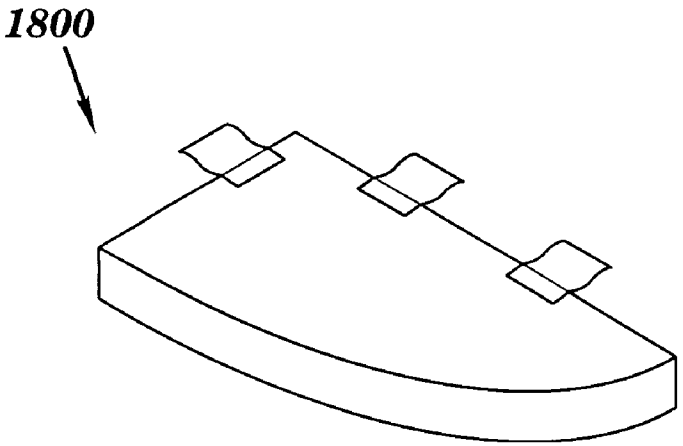
FIG. 9 is a perspective view of another embodiment of a floatation apparatus in accordance with the present invention.

FIG. 8 is another embodiment of a shell rigged for sculling which includes a plurality of outriggers to which outriggers are attached rectangular-shaped floatation apparatus 1700 in accordance with the present invention. FIG. 9 illustrates a floatation apparatus 1800 having a curved outer edge. FIG. 10 illustrates a floatation apparatus 1900 having a round or circular configuration. From the present description, it will be appreciated that other suitable shapes and sizes for the floatation apparatus may be employed.

Figure 11:
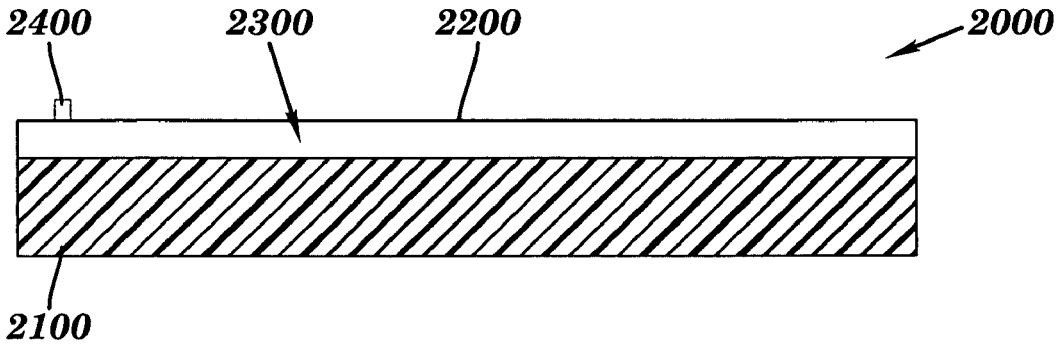
FIG. 11 is a cross-sectional view of another embodiment of a floatation apparatus in accordance with the present invention having an inflatable chamber.

In other examples, a floatation apparatus may be made of other materials that are suitable to aid in keeping rowers afloat or to provide buoyancy, such as, for example, pieces of foam, an air chamber to be inflated, a hybrid combination, and/or other types of material recommended by the U.S. Coast Guard. For example, as shown in FIG. 11, a floatation apparatus 2000 may include a buoyant material 2100 and an inflatable bag or member 2200 defining a chamber 2300 therein. Inflatable member 2200 may include a resealable valve 2400 which a rower may use to inflate chamber 2300 with air to increase the buoyancy of the floatation apparatus in the event that the floatation apparatus is used as a floatation device.

Figure 12:
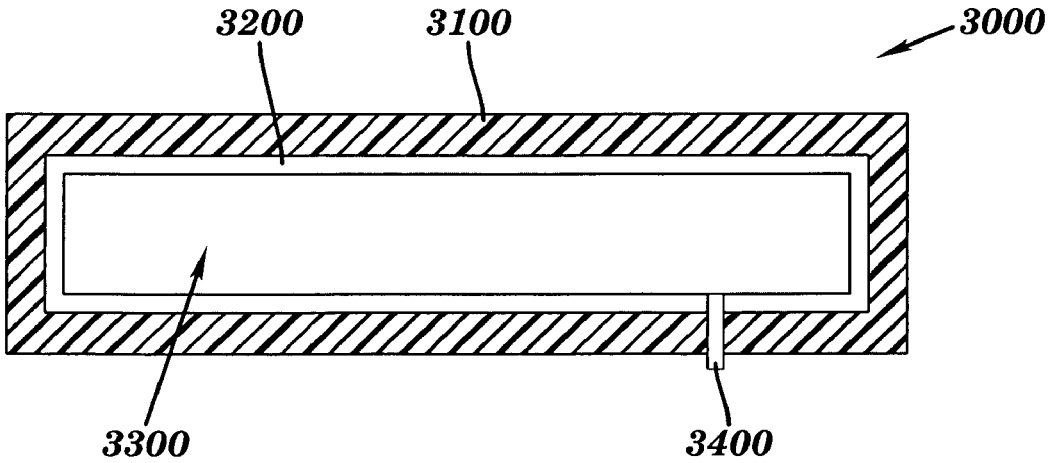
FIG. 12 is a cross-sectional view of another embodiment of a floatation apparatus in accordance with the present invention.

FIG. 12 is another embodiment of a floatation apparatus 3000 may include an outer buoyant layer 3100 (e.g., foam) and an inner impervious layer 3200 defining a chamber 3300 therein. A resealable valve 3400 may be provided to allow a rider to inflate chamber 3300 with air to increase the buoyancy of the floatation apparatus prior or after attaching the floatation device to the outrigger.

In further examples, the floatation apparatus may include other suitable shapes which are positionable between the triangular-shaped or other openings defined by the elongated members forming the outriggers. For example, while the peripheral edge of the floatation apparatus may be sized and configured to be disposed adjacent to the elongated members of the outriggers, it will be appreciated that other shapes may be suitably employed having only one or more portions of the peripheral edge disposed adjacent to the elongated members of the outriggers. Further, other suitable releasably attachable means may be provided wherein the entire peripheral edge of the floatation apparatus is spaced-apart from the elongated members forming the outrigger. In addition, the floatation apparatus need not extend across the entire opening formed by the elongated members of an outrigger. Where only two elongated members are used for each outrigger, e.g., where there is no center elongated member extending outwardly normal form the shell, the floatation apparatus of the present invention may have peripheral edges or be suitably attachable to the two elongated member of the outriggers.

Rowing shells are typically narrow and unstable vessels and require considerable balance and coordination by the rowers to move them through the water without capsizing. At times, when a shell begins to capsize, the shell can be checked by the rowers shifting their weight or using the oars to stabilize the shell. There is a point of rotation beyond which the shell will continue to rotate and invert. From the present description, it will be appreciated by those skilled in the art that a added benefit of the floatation apparatus of the present invention is that it results in a capsizing shell approaching the critical point of rotation at a slower rate, thus allowing more time for the rowers to take corrective action to prevent capsize.

In addition, often when a rowing shell operates in rough water, waves break over the sides of and into the cockpit adding weight and burdening the shell. From the present invention, it will be appreciated by those skilled in the art that an added benefit of the floatation apparatus of the present invention is that it creates a barrier that exposes less of the cockpit to the rough water thereby reducing the amount of water that may be taken on by the shell.

Further, from the present description, it will be appreciated by those skilled in the art that in the unlikely event of the shell capsizing, the floatation apparatus of the present invention provides personal flotation devices which are readily accessible and within reach of each rower. Thus, a rower need not wait for the chase boat to travel to the shell and deploy flotation devices.

Each rowing boat or shell may include one or more of the floatation apparatus in accordance with the present invention releasably secured to different riggers on, for example, the port and/or starboard sides. The floatation apparatus may be sized and configured to prevent interference with the operation of the oars and avoid any instability to the rowing shell.

Figure 13:
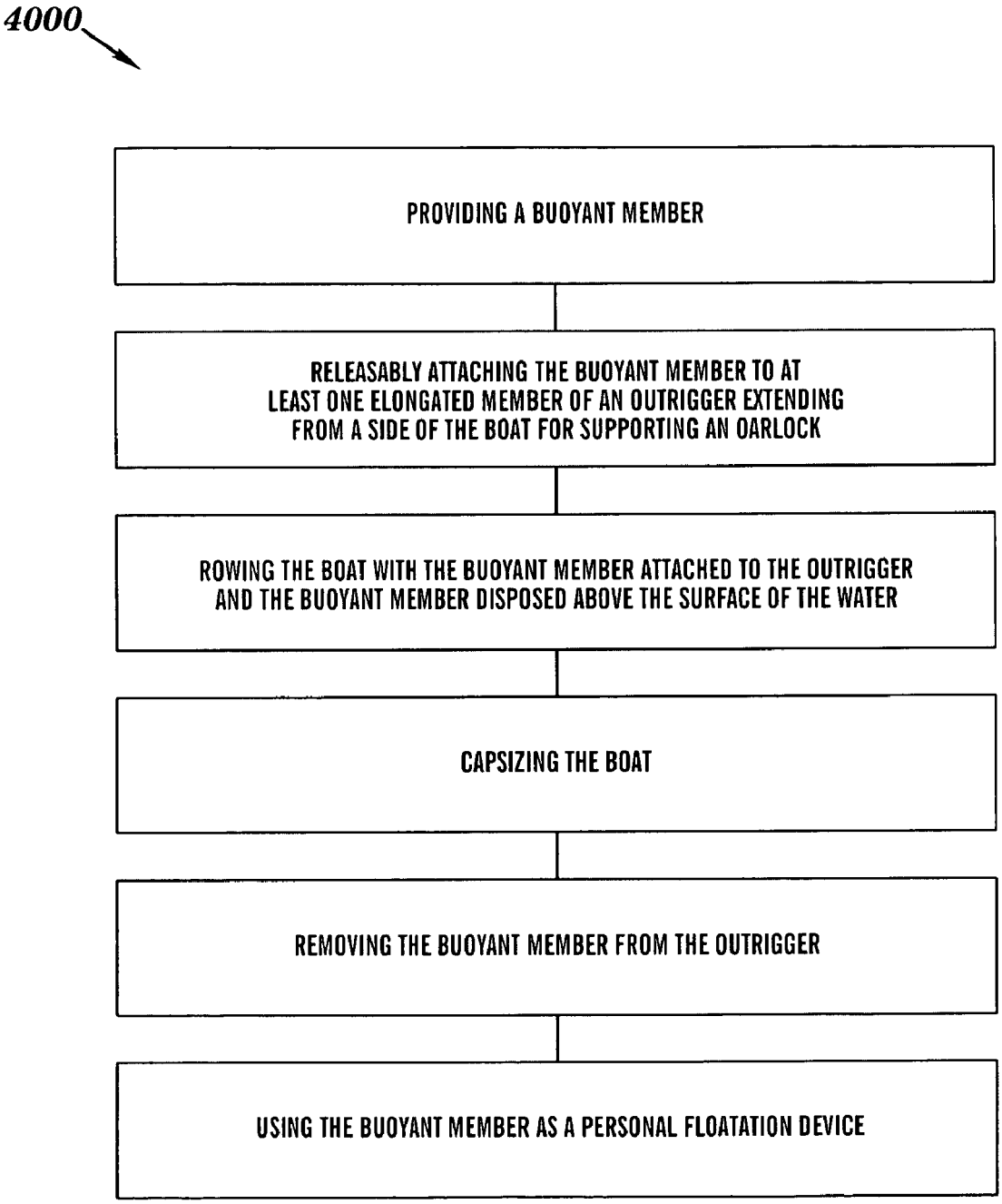
FIG. 13 is flowchart of one embodiment a method for aiding a rower of a boat in the event that the boat capsizes.

FIG. 13 illustrates a flowchart of one embodiment of a method 4000 for aiding a rower of a boat in the event that the boat capsizes.

Figure 14:
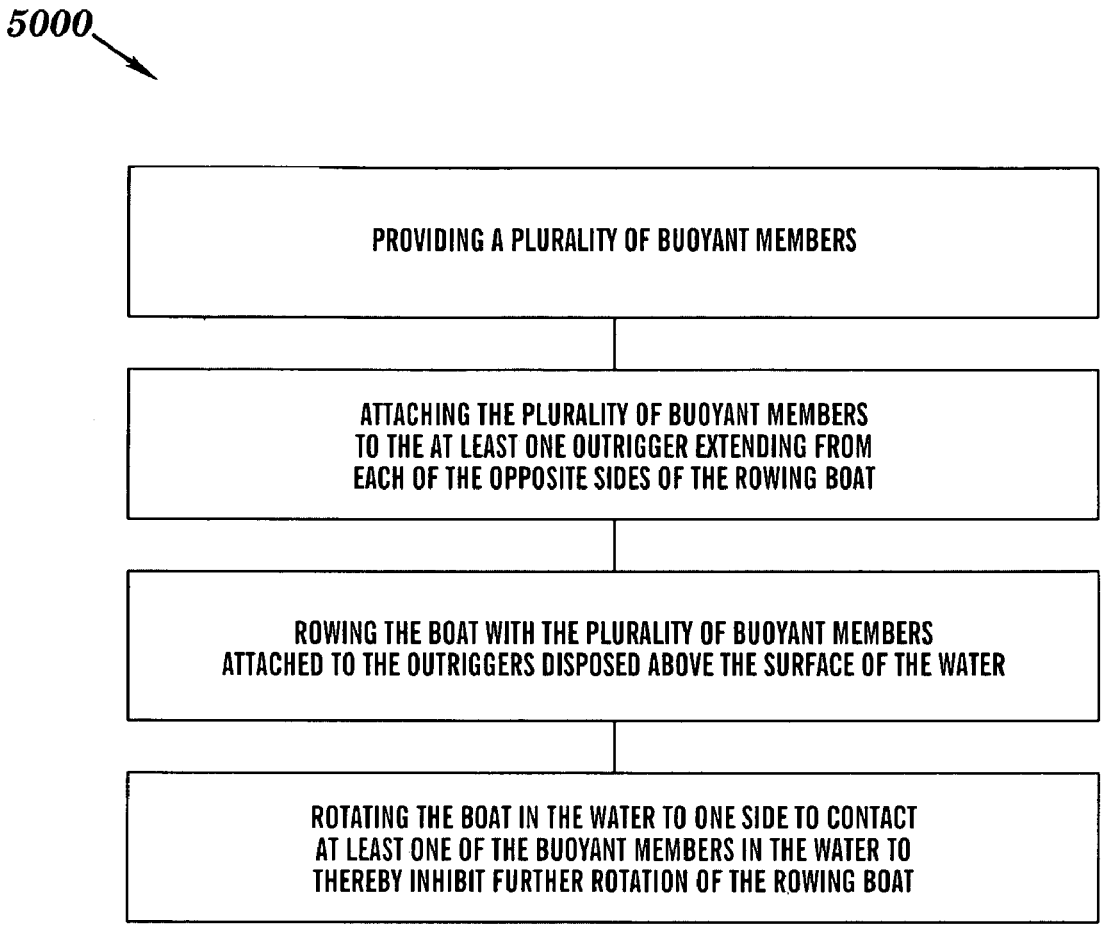
FIG. 14 is flowchart of one embodiment a method for inhibiting capsizing of a rowing boat having at least one outrigger extending from each side of the rowing boat for supporting a plurality of oarlocks.

FIG. 14 illustrates a flowchart of one embodiment of a method 5000 for inhibiting capsizing of a rowing boat having at least one outrigger extending from each side of the rowing boat for supporting a plurality of oarlocks.

Although the invention has been particularly shown and described with reference to certain preferred embodiments, it will be readily appreciated by those of ordinary skill in the art that various changes and modifications may be made therein, without departing from the spirit and scope of the invention.

The invention claim is:

1. A floatation apparatus attachable to an outrigger extending from a side of a rowing boat for supporting an oarlock, the floatation apparatus comprising:

a generally triangular-shaped planar member receivable between a triangular-shaped opening defined by a plurality of elongated members of the outrigger and the side of the boat;

a plurality of releasably attachable members attachable to the generally triangular-shaped planar member for releasably attaching the floatation apparatus to the outrigger so that the generally triangular-shaped planar member is spaced-apart from a surface of the water when the boat is orientated upright; and wherein said generally triangular-shaped planar member comprises a buoyant material.

2. The floatation apparatus of claim 1 wherein said generally triangular-shaped planar member comprises a right triangular-shaped member.

3. The floatation apparatus of claim 1 wherein said generally triangular-shaped planar member comprises sides of about 1.5 feet to about 2 feet.

4. The floatation apparatus of claim 1 wherein said generally triangular-shaped planar member comprises a thickness of about 3 inches.

5. The floatation apparatus of claim 1 wherein said plurality of releasably attachable members comprises at least one of a web material, a rope, hook and loop fasteners, and snap fasteners.

6. The floatation apparatus of claim 1 wherein said generally triangular-shaped planar member comprises a plurality of apertures extending from a top surface to a bottom surface for receiving said plurality of releasably attachable members for releasably attaching the floatation apparatus to the plurality of elongated members of the outrigger.

7. The floatation apparatus of claim 6 wherein said plurality of releasably attachable members comprises at least one of a web material, a rope, hook and loop fasteners, and snap fasteners that extend through said plurality of apertures.

8. The floatation apparatus of claim 1 wherein said generally triangular-shaped planar member comprises an inflatable chamber.

9. The floatation apparatus of claim 1 wherein said triangular-shaped planar member comprises a closed cell foam material.

10. A method for aiding a rower of a boat in the event that the boat capsizes, the method comprising:

providing a buoyant member;

releasably attaching the buoyant member to at least one elongated member of an outrigger extending from a side of the boat for supporting an oarlock;

rowing the boat with the buoyant member attached to the outrigger and with the buoyant member spaced-apart from a surface of the water;

capsizing the boat;

removing the buoyant member from the outrigger; and using the buoyant member as a personal floatation device.

11. The method of claim 10 wherein the providing comprises providing the buoyant member comprising a buoyant planar member.

12. The method of claim 10 wherein the providing comprises providing the buoyant member comprising a generally triangular-shaped planar buoyant member.

13. The method of claim 10 wherein the providing comprises providing the buoyant member comprising a rectangular-shaped planar buoyant member.

14. The method of claim 10 wherein the releasably attaching comprises passing a plurality of releasably attachable members through a plurality of apertures in the buoyant member.

15. The method of claim 10 wherein the releasably attaching comprises releasably attaching the buoyant member to the outside of the boat.

16. The method of claim 10 wherein the removing the buoyant member further comprises inflating a chamber to provide additional buoyancy for use of the buoyant member as a personal floatation device.

17. The method of claim 10 wherein the releasably attaching comprises releasably attaching the buoyant member in an opening formed by a plurality of elongated members of the outrigger.

18. A rowing boat comprising:

a shell;

a plurality of outriggers attachable to said shell; and a plurality of floatation apparatus as recited in claim 1 releasably attachable to said plurality of outriggers.

* * * * *